US005207789A

United States Patent [19]

Gates

[11] Patent Number: 5,207,789

[45] Date of Patent: May 4, 1993

[54] BASKETBALL SHOOTING AID

[75] Inventor: Horace Gates, Central City, Iowa

[73] Assignee: Accu-Rim, Inc., Central City, Iowa

[21] Appl. No.: 863,111

[22] Filed: Apr. 3, 1992

[51] Int. Cl.[5] ..... A63B 63/08

[52] U.S. Cl. ..... 273/1.5 A

[58] Field of Search ..... 273/1.5 A

[56] References Cited

U.S. PATENT DOCUMENTS

| | | | |
|---|---|---|---|
| 2,039,798 | 5/1936 | Hayden | 273/1.5 A |
| 2,694,572 | 11/1954 | Crisp | 273/1.5 A |
| 2,708,576 | 5/1955 | Verkuilen | 273/1.5 A |
| 2,918,283 | 12/1959 | Marschalk | 273/1.5 A |
| 4,805,903 | 2/1989 | McArdle | 273/1.5 R |
| 4,836,539 | 6/1989 | Knapp | 273/1.5 A |

OTHER PUBLICATIONS

Korney Board Aids, Basketball Coaching and Training Aids, 1989 School Mail Order Catalog, pp. 8 & 17 Dec. 1988.

*Primary Examiner*—Paul E. Shapiro

*Attorney, Agent, or Firm*—James C. Nemmers

[57] ABSTRACT

A basketball training aid for improving a player's shooting accuracy. The aid is a removable rim that is placed over a regulation basketball goal to reduce the inside diameter of the goal. The players can then practice with a smaller goal and thereby improve both accuracy and concentration.

5 Claims, 2 Drawing Sheets

FIG. 4
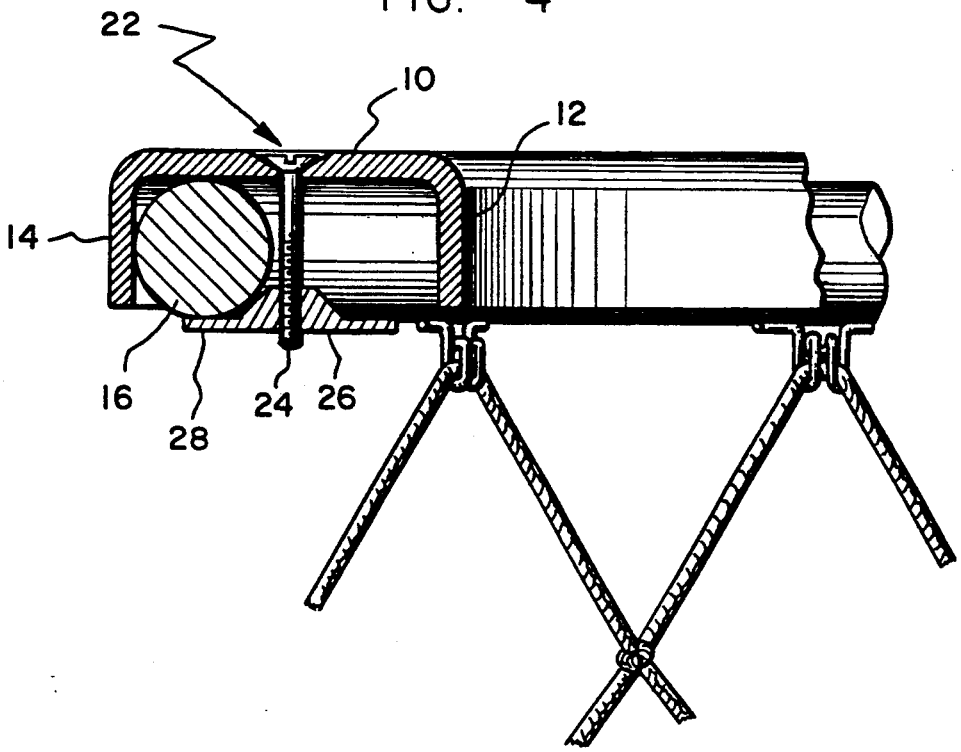
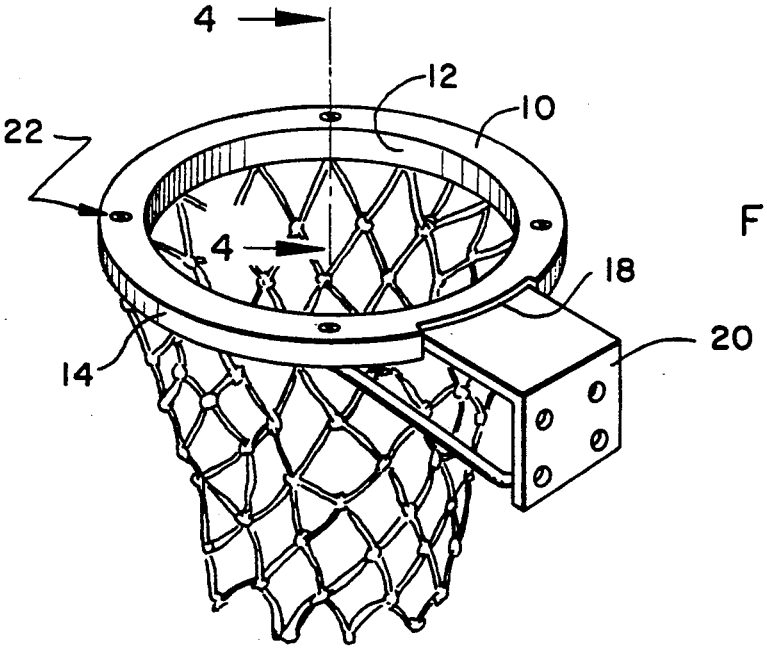
FIG. 3

BASKETBALL SHOOTING AID

BACKGROUND OF THE INVENTION

The sport of basketball continues to be increasingly popular at all levels of play. Children start at a very early age to "shoot baskets", and the best of them will ultimately play organized competitive basketball for many years and may even achieve the level of playing professional basketball. At all levels of play, one of the keys to success is the ability to make a high percentage of goals and with the advent of the three-point goal and with the increased importance of free-throw shooting, improved shooting accuracy is important.

Even gifted athletes have found that the only proven way to improve shooting accuracy is dedication and hard work. In other words, the only way to improve shooting accuracy is to practice and attain a level of shooting confidence that will enable the athlete to perform more successfully no matter at what level the athlete is competing.

Therefore, whether an individual strives to play at a high school, college, or professional level, there is a need for practice or training aid that will enable the individual to improve his or her shooting accuracy.

There is also a need for any training or practice aid which will improve shooting accuracy under the most realistic conditions so that the individual does not have to alter his or her particular shooting style.

There is also a need for any practice or training aid which will improve shooting accuracy, which is easy to use and which is inexpensive.

SUMMARY OF THE INVENTION

The device of the invention is an annular shaped member that is removably attached on top of the rim of a regulation basketball goal so as to reduce the inside diameter of the goal thereby requiring the player to practice using a smaller goal but without altering his or her shooting style. The device is attached using suitable fasteners so that it can be quickly and easily installed and removed.

BRIEF DESCRIPTION OF THE DRAWING

FIG. 3 is a perspective view of the device as installed on a regulation basketball goal; and FIG. 4 is a sectional view taken on the line 4—4 of FIG. 3.

DESCRIPTION OF THE PREFERRED EMBODIMENT OF THE INVENTION

Figure 1:
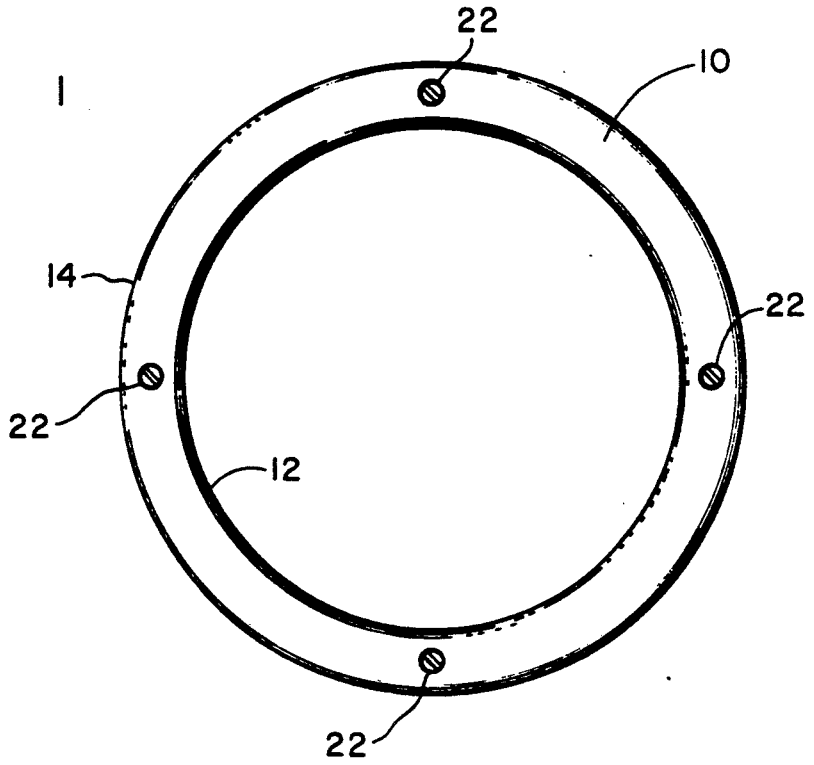
FIG. 1 is a top plan view of a device constructed according to the principles of the invention.

Referring to the drawings, the device of the invention is an annular shaped member that has a top portion 10 with a downwardly extending inner edge 12 and a downwardly extending outer edge 14 all integrally formed so that the device is one piece. The device can be constructed of any suitable material, such as a high-impact polymer composite so that it is both lightweight and durable.

The top portion 10 preferably has a smooth, flat upper surface, and the corners where the top portion 10 is joined to the edges 12 and 14 ar preferably smooth and rounded.

As best illustrated in FIG. 4, the inside diameter of the outer edge is slightly greater than the outside diameter of the rim 16 of a regulation-sized basketball goal. Also, the inside diameter of the inner edge 12 is less than the inside diameter of the rim 16 so that when the device is installed on the rim 16 as shown in FIG. 4, the diameter of the opening through the goal is reduced substantially. Preferably, the diameter of the opening normally provided by the regulation rim 16 is reduced by slightly more than two inches. Obviously, the diameter of this opening must be greater than the diameter of a standard regulation basketball.

Figure 2:
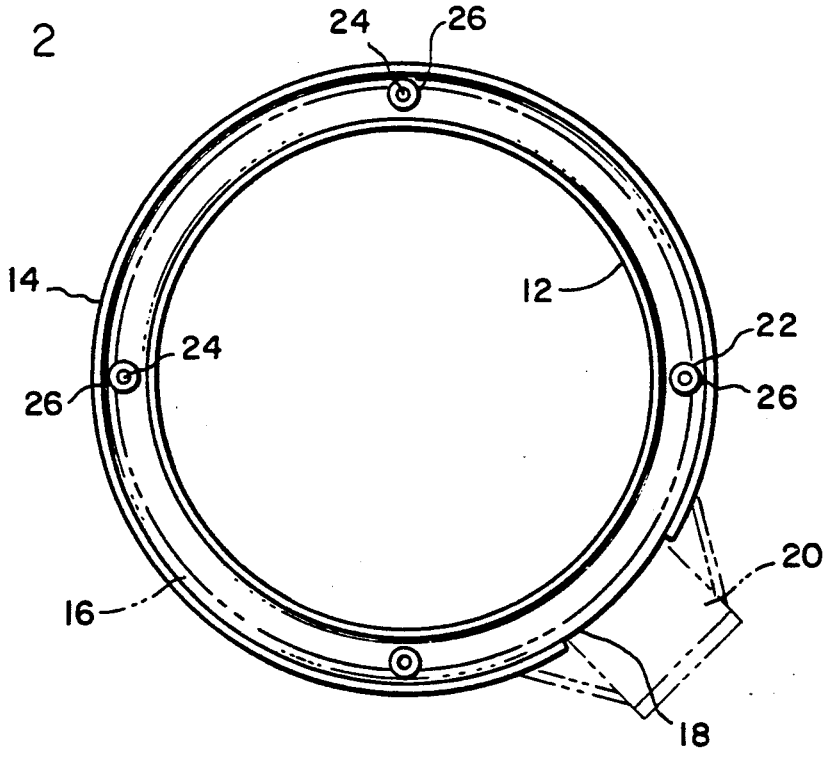
FIG. 2 is a bottom view of the device of the invention.

As best seen in FIG. 2, the outer edge 14 and a portion of the top portion 10 is notched at 18 so that the device can be installed over the rim 16 without interference from the support 20 for the rim 16.

In order to removably affix the device to the rim 16, there are provided a plurality of fasteners indicated generally by the reference numeral 22. Each fastener 22 has a threaded male member 24 and a threaded female member 26. The top of each threaded male member 24 is preferably slotted to accommodate a screwdriver, and the top portion 10 of the device is preferably countersunk so that the threaded male members will not extend above the top surface of the top portion 10. Each of the female threaded members 26 has outwardly extending tabs 28 that will engage beneath the rim 16 so that when the fasteners 22 are tightened the rim will be held between the tabs 28 and the bottom surface of top portion 10. The tabs 28 may be washers and preferably are formed integrally with the threaded members 26 to make the installation as easy as possible.

As best seen in FIG. 4, the rim 16 is nested along the inside of the outer edge 14 so that the inner edge 12 reduces the size of the opening through the goal. Once properly installed, the appearance of the basketball goal will be altered very little. Obviously, the height of the regulation goal is not altered, nor is the goal altered in any other way. The device of the invention can be quickly and easily installed or removed requiring only a screwdriver for installation.

Once properly installed, with the reduced opening in the goal, a player practicing with a smaller goal will obviously have to improve his or her accuracy. Such practice also requires increased concentration. Once the player is able to consistently make a high percentage of shots using the device of the invention, the player will be confident in real game situations. The device of the invention thus allows a player to obtain a higher level of shooting confidence that will enable the player to perform more successfully at any level of competition.

The device of the invention has been described in connection with the preferred embodiment thereof. Obviously, various revisions and modifications can be made to the preferred embodiment while still utilizing the principles of the invention. For example, fastening means other than the threaded members illustrated could be used. It is my intention however that all such revisions and modifications that are obviously to those skilled in the art will be included within the scope of the following claims.

What is claimed as follows:

1. A device for improving the shooting accuracy of a basketball player shooting a basketball at a goal that includes a circular rim having regulation outside and inside diameters, said device comprising an annular member having a top portion and an inner edge and an outer edge extending downwardly from the top portion, both the inner edge and the outer edge being integral with the top portion to form a somewhat U-shaped cross section of the annular member, the outer edge having an inside diameter that is slightly greater than the outside diameter of the rim of the goal, the inner edge having an inside diameter that is less than the inside diameter of the rim of the goal, and means for removably attaching the device to the goal with the annular member on top of the rim and with the outer edge extending around the outside of the rim.

2. The device of claim 1 in which the top surface of the annular member is substantially flat and all in one plane.

3. The device of claim 2 in which the inside diameter of the inner edge is at least two inches less than the inside diameter of the rim but greater than the diameter of a regulation basketball.

4. The device of claim 3 in which the means for removably attaching the device to the rim comprises a plurality of male fasteners extending through the top portion, and corresponding female fasteners engageable with the male fasteners, the female fasteners having outwardly extending portions that are engageable beneath the rim when the device is attached to the rim.

5. The device of claim 4 in which the male and female fasteners are threaded members, and the outwardly extending portion of each member is a washer, the washer being formed integrally with the female threaded member.

* * * * *